US008915217B2

(12) United States Patent
Rop et al.

(10) Patent No.: US 8,915,217 B2
(45) Date of Patent: Dec. 23, 2014

(54) CASCADING ONCE THROUGH EVAPORATOR

(75) Inventors: Peter Simon Rop, Zoetermeer (NL); Walter Adriaan Kramer, Rotterdam (NL)

(73) Assignee: NEM Energy B.V., Zoeterwoude (NL)

( * ) Notice: Subject to any disclaimer, the term of this patent is extended or adjusted under 35 U.S.C. 154(b) by 446 days.

(21) Appl. No.: 13/499,491

(22) PCT Filed: Oct. 6, 2010

(86) PCT No.: PCT/NL2010/050655

§ 371 (c)(1),
(2), (4) Date: Mar. 30, 2012

(87) PCT Pub. No.: WO2011/043662

PCT Pub. Date: Apr. 14, 2011

(65) Prior Publication Data

US 2012/0180739 A1 Jul. 19, 2012

Related U.S. Application Data

(60) Provisional application No. 61/248,933, filed on Oct. 6, 2009.

(30) Foreign Application Priority Data

Oct. 6, 2009 (NL) ..... 2003596

(51) Int. Cl.
*F22B 29/06* (2006.01)
*F22B 37/26* (2006.01)
*F22B 1/18* (2006.01)

(52) U.S. Cl.
CPC ..... *F22B 29/062* (2013.01); *F22B 29/06* (2013.01); *F22B 37/26* (2013.01); *F22B 1/18* (2013.01)
USPC ..... 122/7 R; 122/406.4

(58) Field of Classification Search
CPC ..... F22B 29/12; F22B 29/06; F22B 29/026; F22B 5/14; F22B 35/10; F22B 35/102; F22B 13/06; F22B 29/08; F22B 1/1815; F22B 1/1876; F22B 1/1869; F22B 1/1846; F22B 1/1884; F22D 11/00; G01N 9/32; F22G 5/02; F22G 5/20; F22G 7/08; F22G 7/14; F22G 7/145; F22G 7/065; F22G 7/005; F22G 7/06; F22G 7/10
USPC ..... 122/1 B, 406.4, 448.4, 469, 479.7, 461, 122/7 R, 451 S
See application file for complete search history.

(56) References Cited

U.S. PATENT DOCUMENTS
3,150,487 A 9/1964 Mangan et al.
4,315,485 A 2/1982 Kawamura et al.

(Continued)

FOREIGN PATENT DOCUMENTS

EP 0 309 792 A1 5/1989

(Continued)

OTHER PUBLICATIONS
English abstract for JP 3-22102, Sep. 30, 1991.

(Continued)

*Primary Examiner* — Gregory A Wilson

(57) ABSTRACT
A steam generator includes a substantially horizontal gas conduit (1) to guide a heating gas flow (2) and an evaporator unit positioned at least partially in the horizontal gas conduit for transferring heat from the heating gas to a flow medium which flows through the evaporator unit. The heat transfer section of the evaporator unit of the steam generator is bottom fed, which means that the inlet conduit is arranged at a lower region of the heat transfer section. The outlet conduit is arranged at an upper region. The inlet conduit allows an once through operation of the evaporator section which is necessary to enable operation under supercritical circumstances. The evaporator unit includes at least two evaporator stages (3, 4) which are arranged in a cascade. Each evaporator stage includes a heat transfer section (12, 21) and a separator (14, 23). The presence of the separators (14, 23) subdivides the evaporator unit into evaporator stages (3, 4).

11 Claims, 1 Drawing Sheet

(56) References Cited

U.S. PATENT DOCUMENTS

| | | | | |
|---|---|---|---|---|
| 5,293,842 | A | 3/1994 | Loesel | |
| 6,189,491 | B1 | 2/2001 | Wittchow et al. | |
| 6,557,500 | B1 * | 5/2003 | Schroeder | 122/7 R |
| 6,957,630 | B1 * | 10/2005 | Mastronarde | 122/406.4 |
| 7,243,618 | B2 * | 7/2007 | Gurevich | 122/7 R |
| 7,270,086 | B2 * | 9/2007 | Franke et al. | 122/7 R |
| 7,281,499 | B2 * | 10/2007 | Franke et al. | 122/406.5 |
| 2008/0190382 | A1 | 8/2008 | Bruckner et al. | |
| 2013/0180228 | A1 * | 7/2013 | Zhang | 60/39.182 |
| 2014/0216363 | A1 * | 8/2014 | Rancruel et al. | 122/406.4 |
| 2014/0216365 | A1 * | 8/2014 | Rancruel et al. | 122/7 R |

FOREIGN PATENT DOCUMENTS

| | | | |
|---|---|---|---|
| EP | 0 794 320 | A1 | 9/1997 |
| GB | 443765 | | 5/1936 |
| JP | 3-221702 | | 9/1991 |
| WO | 2007/133071 | A2 | 11/2007 |

OTHER PUBLICATIONS

English (machine) translation for EP 0794320, Sep. 10, 1997.

* cited by examiner

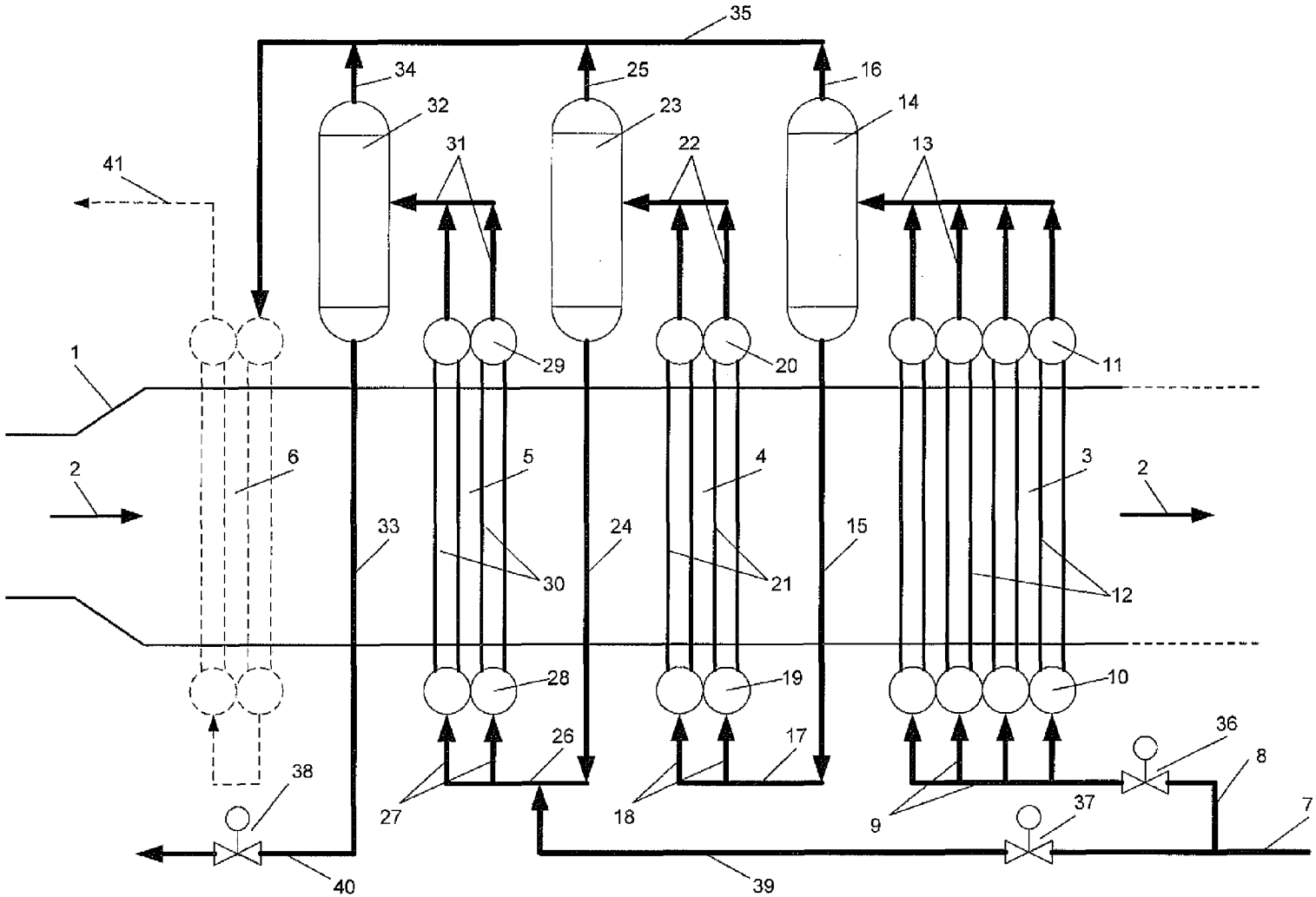
1
2
3
4
5
6
7
8
9
10
11
12
13
14
15
16
17
18
19
20
21
22
23
24
25
26
27
28
29
30
31
32
33
34
35
36
37
38
39
40
41

CASCADING ONCE THROUGH EVAPORATOR

CROSS-REFERENCE TO RELATED APPLICATIONS

This application is the National Stage of International Application No. PCT/NL2010/050655, filed Oct. 6, 2010, which claims the benefit of Netherlands Application No. 2003596, filed Oct. 6, 2009, and U.S. Provisional Application No. 61/248,933, filed Oct. 6, 2009, the contents of all of which are incorporated by reference herein.

FIELD OF THE INVENTION

The present invention relates to a steam generator comprising a substantially horizontal gas conduit for guiding a heating gas flow. An evaporator unit is positioned at least partially in the horizontal gas conduit for transferring heat from the gas flow to a flow medium which flows through the evaporator unit. In particular, the steam generator is suitable to operate under both subcritical as supercritical circumstances.

BACKGROUND OF THE INVENTION

A steam generator is for example known from WO2007/133071 which discloses a single pass evaporator unit which is arranged in a substantially horizontal gas conduit. The evaporator unit has at least one heat transfer section which comprises vertically extending heat transfer tubes. The heat transfer tubes are arranged in a matrix having arrays of heat transfer tubes in a direction transversal to the flow direction of the heating gas and arrays of heat transfer tubes downstream the gas flow. The heat transfer section is in fluid communication with an inlet conduit for supplying a liquid flow medium, generally water, to the heat transfer tubes and an outlet conduit for transferring the flow medium as a two phase mixture of liquid and vapour to a separator. The heat transfer section is bottom fed, which means that the inlet conduit is arranged at a lower region of the heat transfer section. The inlet conduit allows an once through operation of the evaporator section which is necessary to enable operation under supercritical circumstances. The outlet conduit is arranged at an upper region.

The heat transfer tubes are positioned downstream the heating gas flow in the gas conduit. The heating gas passes the subsequent positioned heat transfer tubes which brings a cooling down of the heating gas and a heating up of the heat transfer tubes. A front positioned heat transfer tube is more heated than a back positioned heat transfer tube. The temperature difference between heating gas and the flow medium upstream the gas flow is bigger than the temperature difference between the heating gas and the flow medium in a more downstream positioned heat transfer tube. This normally results in a bigger contribution of the front positioned heat transfer tubes to the heat transfer and the generation of steam. A problem relating to this phenomenon is that a more front positioned heat transfer tube may get damaged by overheating while more back positioned heat transfer tubes do not generate sufficient steam. It is desired to generate steam by the evaporator, wherein all the heat transfer tubes have an approximately equal contribution to the steam generation. It is desired to keep the reduction of the temperature difference within acceptable limits. It is desired that all heat transfer tubes produce an optimum amount of steam.

An additional problem relating especially to the most upstream positioned heat transfer tube, is that the supply of liquid may become too low. A complete evaporation in one or more of the heat transfer tubes of the evaporator unit may impair stability of operation. The heat transfer tube may dry out and become overheated which could lead to damages.

One possible solution to get an optimum contribution of all heat transfer tubes to the steam generation relates to an adjustment of the heat transfer surface of each heat transfer tube. The heating surface of front positioned heat transfer tubes may be enlarged to increase the heat transfer of those tubes. Herewith, an effective contribution of the more back positioned tubes to the steam generation may be achieved.

Such a solution is for example presented in U.S. Pat. No. 6,189,491 which discloses a once-through steam generator in a horizontal type of construction for a through-flow of the heating gas in an approximately horizontal direction. The described once-through steam generator comprises a number of approximately vertically disposed heat transfer tubes, which are commonly connected in parallel for a through flow of a flow medium. The heat transfer tubes are arranged in parallel side by side in the horizontal gas conduit. During use the heat transfer tubes, which are arranged upstream of the heating gas flow will be more heated, than the heat transfer tubes which are arranged downstream. In contrast to a desired equally contribution to the steam production, the most upstream arranged heat transfer tube in the heating gas flow would normally produce the most vapour and would therefore have the largest flow rate of flow medium.

U.S. Pat. No. 6,189,491 provides a possible solution for this problem by optimizing the configuration of the heat transfer tubes in a heat transfer section. The configuration of the heat transfer tubes in the heat transfer section is adapted to compensate for variations in heating in downstream direction of the heat transfer section. Each front positioned heat transfer tube is configured for a higher flow rate of the flow medium than each heat transfer tube disposed downstream of it in the heating-gas direction. A heat transfer tube may have for example a larger inside diameter than a heat transfer tube disposed downstream of it in the heating gas direction. Heat transfer tubes in a region of a relatively high heating gas temperature have a comparatively high flow rate of flow medium. However, this proposed solution results in a more complex and large construction of the heat transfer section. A distribution or a collection element mounted at an end of the heat transfer tubes may for example have a complex configuration to be able to connect it to the varying inside diameters of the heat transfer tubes.

In another proposed embodiment in U.S. Pat. No. 6,189,491 a choke device is connected upstream of a number of heat transfer tubes. The flow rate of the flow medium through the heat transfer tubes can be controlled by the choke device. However, also this solution has not appeared to be satisfying. The configuration of the heat transfer section including a choke device is more complex and susceptible to failures.

GB443,765 discloses a high pressure steam generator. The steam generator includes a tube system which comprises a plurality of temperature stages through which the working medium flows in series. A primary separator is provided between each pair of adjacent stages to separate liquid from steam. The liquid delivered to each primary separator flows therefrom to the next adjacent temperature stage. The delivered steam flows via pipes therefrom to a secondary or main separator common to all stages. With a view to ensure smooth operation of the steam generator in spite of load variations, the ratio of the rate of steam delivery from the primary separators to the rate at which medium is fed to the generator should be maintained substantially constant at any given load. Means for throttling the flow of steam from each of the separators are provided whereby at all loads approximately one fifth of the total quantity of working medium fed to the generator per unit of time at any given load is delivered in the form of steam from each of the separators to the pipes. Thus, the ratio of the quantity of steam delivered from any one separator per unit of time to the quantity of liquid supplied to the generator during that time must be substantially constant at any given load. Means are provided whereby the effective cross-section available for the flow of steam through each throttling device is automatically controlled by a "condition" of the working medium within the system of the generator.

A problem to this configuration of the steam generator is that it includes a plurality of throttling means which makes the configuration more complex and susceptible to failures. The presence of the throttling means increases the flow resistance of the tube system. Another problem is that the common main separator has a complex configuration including a plurality of inlet ports for connecting the pipes originating from the primary separators.

Another problem of the disclosed steam generator is that a two phase mixture of water and steam is fed downwardly through the temperature stages. Generated steam tend to rise in the temperature stage which disturbs the evaporating process. The disclosed steam generator entails stability problems.

EP0.794.320 and EP0.309.792 disclose an exhaust boiler including a high pressure steam generator and a low pressure steam generator. The high and low pressure steam generators comprise each an evaporator unit which operate in separate circuits to generate steam for respectively a low pressure steam turbine and a high pressure steam turbine.

Despite of taken measures, it has appeared in practice that it is still a problem to known steam generators that the evaporator unit appears to be susceptible for overheating. There is still a risk that the front positioned heat transfer tubes deliver a lot of steam and that more back positioned heat transfer tubes in comparison hardly delivers steam. A major problem is still that, the upper ends of the front positioned heat transfer tubes are susceptible for wear and damage as a result of overheating.

A further problem arises when all heat transfer tubes generate superheated vapour having a steam quality equal or larger than one. This may cause temperature stratification over the height of the gas conduit. Heating gas temperature stratification is undesirable because it impairs thermal performance of both the steam generating system itself and possible gas side downstream heat transfer surfaces.

SUMMARY OF THE INVENTION

It is an object of the present invention to overcome at least one of the above-mentioned drawbacks, at least partially, and/or to provide a useable alternative. In particular, it is an object of the invention to provide a steam generator having an evaporator unit including a conventional heat transfer section with a simple configuration which is less susceptible to overheating and/or failure of components.

This object is achieved by a steam generator according to the present invention.

A steam generator according to the invention comprises a substantially horizontal gas conduit to guide a heating gas flow and an evaporator unit positioned at least partially in the horizontal gas conduit for transferring heat from the heating gas to a flow medium which flows through the evaporator unit.

In particular, the steam generator is suitable to operate under both subcritical as supercritical circumstances. Supercritical steam generators are frequently used for the production of electric power. Supercritical steam generators operate at supercritical pressure. In contrast to a "subcritical boiler", a supercritical steam generator operates at such a high pressure (over 3200 PSI, 22 MPa, 220 bar) that actual boiling ceases to occur. The evaporator has no liquid water-steam separation. There is no generation of steam bubbles within the flow medium, because the pressure is above the critical pressure at which steam bubbles can form. The term "boiler" should not be used for a supercritical pressure steam generator, as no "boiling" actually occurs in this device. The flow medium passes below the critical point as it does work in a high pressure turbine and enters the generator's condenser. This results in less fuel use and therefore less greenhouse gas production.

The heat transfer section of the evaporator unit of the steam generator according to the invention is preferably bottom fed, which means that the inlet conduit is arranged at a lower region of the heat transfer section. The outlet conduit is arranged at an upper region. The inlet conduit allows an once through operation of the evaporator section which is necessary to enable operation under supercritical circumstances.

The steam generator according to the invention is characterised in that the evaporator unit comprises at least two evaporator stages which are arranged in a cascade. Each evaporator stage comprises a heat transfer section and a separator. The presence of the separators subdivides the evaporator unit into evaporator stages.

The heat transfer section has upright positioned heat transfer tubes which are in fluid communication with the inlet conduit to supply the flow medium to the heat transfer tubes and the outlet conduit to discharge the flow medium from the heat transfer tubes. The heat transfer tubes are preferably substantially straight. The flow of the flow medium through the heat transfer tubes of the evaporator stages is preferably co-directed. A heat transfer section comprises a matrix of heat transfer tubes. The matrix may be defined as comprising a first group of arrays of heat transfer tubes in a direction of the gas conduit or alternatively as a second group of arrays of heat transfer tubes in a transversal direction of the gas conduit. The heat transfer tubes may be staggered arranged.

The separator is configured to separate liquid and vapor out of the flow medium which arrives at the separator as a two phase mixture. The separator is in fluid communication with the outlet conduit of the heat transfer section of an evaporator stage wherein separated liquid is discharged via a liquid outlet and wherein separated vapor is discharged via a vapor outlet of the separator.

The presence of multiple evaporator stages and corresponding separators in an evaporator unit may be advantageous because it allows a lower vapor content at the outlet of the heat transfer tubes of those evaporator stages that are intended to discharge the flow medium in a two phase mixture of liquid and vapor. The steam quality of the discharged flow medium from each evaporator stage may be considerably lower in comparison with a evaporator unit without such stages. Advantageously, a lower vapor content may reduce a risk of complete evaporation in one or more of the heat transfer tubes which may reduce problems relating to overheating. Herewith, the stability of the operation of the total steam generation may be further improved.

Advantageously, a cascade arrangement of evaporator stages with corresponding separators may improve a counter flow operation of the steam generator in that a reduction of a temperature difference in between the heating gas and a heat transfer tube downstream the gas conduit may be limited. The improved counter flow operation may result in a better contribution to the steam generation of more back positioned heat transfer tubes. At the same time, it may result in a risk reduction of damage to more front positioned heat transfer tubes due to overheating.

Preferably, at least one evaporator stage is a once through evaporator stage. A once through evaporator unit as the opposite of a circulating evaporator unit relates to an evaporator unit wherein the flow medium only passes one time through the heat transfer tubes of the evaporator unit. The liquid phase of the flow medium is not circulating over the heat transfer tubes of the once through evaporator stage to obtain complete evaporation. The heat transfer section may be bottom fed. The flow medium may be supplied via the inlet conduit from beneath to the heat transfer section at a lower region and discharged via the outlet conduit at an upper region. A once through operation of the evaporator unit may be necessary to operate under supercritical circumstances.

In an embodiment of the steam generator according to the invention the evaporator unit comprises at least three evaporator stages. Preferably, at least three evaporator stages are a single pass evaporator stage in a cascade arrangement. Single pass means here that a flow medium passes the substantially horizontally flowing heating gas only in upward direction from a bottom inlet to a top outlet of the evaporator stage. Due to the cascade arrangement, the flow medium passes several times the heating gas which makes the total evaporator unit of a multi pass type. Advantageously, at least three evaporator stages may result in an optimal arrangement to operate all the evaporator stages with a low vapor content. The steam quality of a first evaporator stage may for example be at most 0.2. The steam quality of a second evaporator stage which is positioned upstream the gas flow may be for example at most 0.4 and a last most upstream positioned third evaporator stage may for example be approximately 1.38. Advantageously, the evaporator stages may provide a more balanced heating of the flow medium in a plurality of heat transfer tubes. The evaporator unit according to the invention which operates with a lower vapor content reduces the risk of complete evaporation in one or more of the evaporator tubes of the evaporator stages concerned. Complete evaporation in one or more of the heat transfer tubes of the evaporator stages concerned would impair stability of operation. Herewith, the presence of multiple evaporator stages in a cascade arrangement may prevent overheating of a heat transfer tube.

In the cascade arrangement of evaporator stages, the liquid outlet of the separator is preferably in fluid communication with an inlet conduit of a next upstream the gas flow positioned heat transfer section. Preferably, the separator of a previous evaporator stage is connected to a next evaporator stage via a downcomer. Since the flow medium is supplied at a lower region of the evaporator stages and upwardly flowing through the heat transfer tubes, the evaporator unit may be further characterized as being co-directed.

In an particular embodiment, at least two evaporator stages are of a once through type. Preferably all evaporator stages are of a once through type. The multiple evaporator stages may be arranged in series, wherein flow medium flows upstream the gas flow i.e. in a counter direction of the heating gas flow. In other words, the flow medium is in a counter current flow with respect to the heating gas. Counter-current flow may be advantageous when superheating in the most upstream the gas flow positioned evaporator stage is required. For the same heat transfer duty, counter-current flow results in increased mean temperature difference between flow medium and heating gas compared to the mean temperature difference for alternative flow configurations as for example con-current flow or cross flow. Increased mean temperature difference results in a lower heat transfer surface requirement for the same heat transfer duty. The configuration of the total evaporator unit of the steam generator according to the invention may have a multi-pass counter-current character.

An advantage of the co-directed counter-current character of the resulting cascaded once-through evaporator unit may be an increase in mean temperature difference between heating gas and tube side flow medium, which may result in a further reduced heat transfer surface requirement for the same heat transfer duty. Additionally, the flow medium passes several times the heating gas which makes the complete evaporator unit of a multi pass type.

In an embodiment of the steam generator according to the invention the heat transfer section of one evaporator stage may comprise a matrix of heat transfer tubes having at most five, in particular three, but preferably two arrays of transversal the gas flow arranged heat transfer tubes. The array may comprise heat transfer tubes which are downstream the gas flow staggered positioned within the matrix. The front positioned heat transfer tubes define a first array, the second array is consequently defined by the heat transfer tubes behind the front positioned heat transfer tubes. The heat transfer tubes of a second array may have one in the gas flow direction aligned heat transfer tube upstream. The reduction of temperature of the heating gas may be limited by the amount of arrays in a downstream direction. The limited amount of heat transfer tubes in the downstream direction may contribute to an improved heating transfer wherein all heat transfer tubes may have an equivalent contribution. Advantageously, problems of overheating a front positioned heat transfer tube may be reduced by the limited amount of arrays.

In an embodiment of the steam generator according to the invention the evaporator unit comprises at least two evaporator stages, wherein a heat transfer section of a most upstream positioned evaporator stage comprises a matrix of heat transfer tubes having at most four, but preferably at most two arrays of transversal the gas flow arranged heat transfer tubes. The most upstream positioned evaporator stage has a higher risk of damage caused by overheating in comparison with more downstream positioned evaporator stages. As explained above a temperature difference between the heat transfer tube and the heating gas over the heat transfer section may be more effective controlled when the heat transfer section does not comprise too many arrays of heat transfer tubes. Therefore, to prevent overheating of a most front positioned heat transfer tube or a lack of steam from a most back positioned heat transfer tube, it may be advantageous to limit the arrays of heat transfer tubes in the most upstream positioned evaporator stage.

Preferably, the diameters of the heat transfer tubes in cross section in subsequent arrays are substantially equal. Corresponding heat transfer tubes having a substantially equal geometry may be used in the arrays of a heat transfer section. Preferably, the heat transfer tubes of a heat transfer section are in fluid communication with each other without any choke or restrictor means like valves to throttle a through flow of a heat transfer tube with respect to another heat transfer tube of the heat transfer section. The heat transfer tubes may be in fluid communication via a header having tube-shaped connector parts. The geometry and dimensions of the tube-shape connector parts may be substantially equal for substantially all heat transfer tubes. Advantageously, such a configuration of heat transfer tubes may result in a simple over all arrangement of the heat transfer section including relatively simple shaped headers to connect the heat transfer tubes together.

In an embodiment of the steam generator according to the invention, the liquid outlet of a first evaporator stage may be connected to an inlet conduit of a second evaporator stage. Preferably, the liquid outlet is connected to a downcomer conduit. Advantageously, this may result in a down flow of a substantially one phase liquid flow instead of a down flow of the two-phase mixture including the vapor flow. The downcomer conduit may be positioned substantially parallel to the heat transfer tubes. The downcomer conduit may have a downcomer inlet at the upper region for a supply of liquid, which is in fluid communication with the liquid outlet of the separator and a downcomer outlet at the lower region which is in fluid communication with an inlet conduit of the heat transfer section of an evaporator unit. Due to the fluid communication the downcomer conduit may provide a hydrostatic balance between a hydrostatic head in the downcomer conduit and a hydrostatic head in the heat transfer tubes of the heat transfer section. Advantageously, the downcomer may prohibit that the amount of liquid in the heat transfer tubes becomes too little or too much. Herewith the level of liquid in the heat transfer tubes remains within an optimal range for a reliable heat transfer. Due to the hydrostatic pressure generated by hydrostatic balance between the downcomer conduit and the heat transfer tubes the risk of drying out and overheating of a heat transfer tube may be further reduced.

Advantageously, due to an optimal control of the hydrostatic balance by the downcomer conduit, the discharging of liquid out of the evaporator unit may be minimized, which results in an increase of the stability of the process in the steam generator.

In a further embodiment liquid may be supplied to the downcomer conduit from anywhere out of the steam generator. For example, liquid may be supplied from other outlets in the steam generator. Liquid conduits anywhere in the steam generator, which could disturb the steam generating process, may be connected to the downcomer conduit for discharging liquids, which advantageously may optimize the steam generating process. In addition the downcomer may be provided with an extra liquid supply, which further reduces the risk of drying out.

Preferably, the downcomer conduit is designed such that the heat transfer is negligible in comparison with the heat transfer in the heat transfer tubes. For example, the downcomer may have a cross sectional area which is at least 20, in particular at least 50, but preferably at least 100, percent bigger than the cross sectional area of a heat transfer tube of the heat transfer section. A negligible friction pressure loss over the fluid communicating conduits provides a positive effect to the hydrostatic balance between the fluid columns in the heat transfer tubes and the downcomer conduit.

The heating surface may be relatively small in comparison with the inner volume of the downcomer conduit, the downcomer conduit may be insulated from the heating gas, or may even be arranged outside the heating gas conduit to advantageously prevent heating of the liquid and consequently the arising of steam. The reduction of steam in the downcomer conduit may give, advantageously, a lower flow resistance to the liquid in the downcomer.

In an embodiment of the steam generator according to the invention an auxiliary supply conduit, a so called by-pass conduit, may be provided to supply flow medium to a more upstream, in particular the most upstream the gas flow arranged evaporator stage. Advantageously, the auxiliary supply conduit may comprise a valve which is normally closed but which may be opened to prohibit overheating of the heat transfer tubes of the evaporator stage.

In an embodiment of the steam generator according to the invention an auxiliary heat transfer section is arranged upstream the gas flow in series with an evaporator stage. The auxiliary heat transfer section may be arranged to evaporate the flow medium to a critical or a supercritical phase. In operation, the auxiliary heat transfer section may produce a heated substantially fully evaporated flow medium. Herewith, advantageously, a simple configuration of the evaporator unit may be obtained without an auxiliary separator connected to an outlet of the most upstream the gas flow positioned heat transfer section.

In an embodiment of the steam generator the configuration may be further simplified by connecting a common vapor conduit from the at least two separators to a superheater. The common vapor conduit may be provided for discharging vapor from the evaporator stages to the superheater. The superheater may be arranged in series with the evaporator unit. The superheater may be arranged up stream the gas flow with respect of the evaporator unit.

Further, the invention relates to a method of generating steam. Particular embodiments of the method may correspond to the embodiments of the steam generator according to the invention.

Further preferred embodiments are described herein.

BRIEF DESCRIPTION OF THE DRAWINGS

The invention will now be explained in more detail with reference to the attached drawings which show a practical embodiment of the invention, but which should not be interpreted as being limiting. In these drawings:

FIG. 1 shows a diagrammatic representation of a steam generator according to the invention.

DETAILED DESCRIPTION OF THE INVENTION

FIG. 1 shows a diagrammatic representation of a steam generator according to the invention. The steam generator of this embodiment comprises a first, second and third evaporator stage 3, 4 and 5 positioned in cascade in a substantially horizontal gas conduit 1. A heating gas indicated by arrows 2 flows through the gas conduit 1 in a length direction. The first evaporator stage 3 is positioned most downstream the gas flow. A flow medium is supplied by one or more main supply conduits 7. Via one or more first inlet conduits 8, distributing manifolds 9 and distributing headers 10, the flow medium is supplied and distributed to a first heat transfer section 12 of the first evaporator stage 3, which at least partially extend within the gas conduit 1.

First inlet conduit 8 comprises a control valve 36 to control the flow rate of the flow medium to the first heat transfer section 12 of the first evaporator stage 3.

The flow medium enters the first heat transfer section 12 in a single phase of liquid. The flow medium is heated by the heating gas 2 and is discharged in a two phase mixture of vapor and liquid to the collecting headers 11. At the upper region of the first heat transfer section 12 of the first evaporator stage 3, the flow medium is collected via collecting headers 11 and transported through a first outlet conduit 13.

Via the outlet conduit 13 the two phase mixture of vapor and liquid is discharged to a first vapor-liquid separator 14. The first separator 14 may comprise a group of separator vessels. The separator vessels of the group may be aligned in a transversal direction with respect to the gas flow 2.

In the vapor-liquid separator 14 the two-phase mixture of flow medium is divided into a liquid and a vapor flow. The flow medium in the liquid phase is discharged via a first liquid outlet to a first downcomer conduit 15, and the flow medium in the vapor phase is discharged via a first vapor outlet and vapor conduits 16 to a vapor collecting conduit 35.

The first downcomer conduit 15 of the first evaporator stage 3 is in fluid communication connected with a second heat transfer section 21 of the second evaporator stage 4 via one or more fluid second inlet conduits 17, distributing manifolds 18 and distributing headers 19. The flow medium in the liquid phase discharged from the first downcomer conduit 15 is supplied and distributed to the heat transfer section 21 of the second evaporator stage 4, which at least partially extend within the gas conduit 1.

At the upper region of the second evaporative heat transfer section 12 of the second evaporator stage 4, the flow medium is collected via collecting headers 20 and transported via a second outlet conduit 22. The flow medium enters the heat transfer section 21 in a single phase of liquid. The flow medium is heated by the heating gas 2 and is discharged in a two phase mixture of vapor and liquid to the collecting headers 20. Via the second outlet conduit 22, the two phase mixture of vapor and liquid is discharged to a second vapor-liquid separator 23.

In the second vapor-liquid separator 23 the two-phase mixture of flow medium is divided into a liquid and a vapor flow. The flow medium in the liquid phase is discharged via a second liquid outlet to a second downcomer conduit 24, and the flow medium in the vapor phase is discharged via a second vapor outlet and vapor conduit 25 to the vapor collecting conduit 35.

The second downcomer conduit 24 of the second evaporator stage 4 is in fluid communication connected with the heat transfer section 30 of the third evaporator stage 5 via one or more fluid third inlet conduits 26, distributing manifolds 27 and distributing headers 28. The flow medium in the liquid phase discharged from second downcomer conduit 24 is supplied and distributed to the heat transfer section 30 of the third evaporator stage 5, which at least partially extend within the gas conduit 2.

At the upper region of the third heat transfer section 30 of the third evaporator stage 5, the flow medium is collected via collecting headers 29 and transported via third outlet conduits 31. The flow medium enters the third heat transfer section 30 in a single phase of liquid. The flow medium is heated by the heating gas flow 2 and is discharged superheated to the collecting headers 29. Via the third outlet conduits 31 the superheated flow medium is discharged to a third vapor-liquid separator 32.

The entire superheated flow medium is discharged from the third vapor-liquid separator 32 via a third vapor outlet and vapor conduits 34 to vapor collecting conduits 35.

The collected mixture of superheated flow medium and flow medium in the vapor phase quits the evaporator stages 3, 4 and 5 through the vapor collecting conduit 35. The mixed flow medium flows to a superheater 6. The superheater 6 is in fluid communication connected with vapour collecting conduit 35. In the superheater 6 the flow medium is superheated and discharged via conduits 41, which forms the main outlet conduit of the steam generator. The separators are not used as a common separator for multiple evaporator stages. Each heat transfer section of the cascading evaporator stages is provided with an own corresponding separator.

The steam generator may comprise a third downcomer 33. The third downcomer 33 is in fluid communication connected with a third liquid outlet of the third separator 32. During normal operation no liquid content of the flow medium is discharged from the third separator 32 to the downcomer conduit 33. Liquid conduits 40 are in fluid communication with vapor-liquid separator 32 via downcomer conduit 33. Liquid conduits 40 comprise control valves 38 to control removal of accumulated liquid phase flow medium from vapor-liquid separator 32 during e.g. start-up and part-load operation.

The third evaporator stage 5 is in direct fluid communication connected with main supply conduit 7 via by-pass conduit 39. By-pass conduit 39 is in fluid communication connected with third inlet conduit 26. The by-pass conduit 39 is in fluid communication connected with the most upstream positioned evaporation stage. By-pass conduit 39 comprises control valves 37 to control direct liquid supply to heat transfer section 30 during start-up. Herewith, overheating of the most upstream positioned heat transfer tubes may be prevented.

The following table indicates representative practical values for operating the steam generator as shown in FIG. 1:

| Gas | | |
|---|---|---|
| Mass flow rate | kg/s | 1000 |
| Specific heat | kJ/kg/° C. | 1 |
| Pinch | ° C. | 5 |
| | Water/Steam | |
| Mass flow rate | kg/s | 100 |
| Pressure | bar | 160 |
| Inlet subcooling | ° C. | 4 |
| Outlet superheat | ° C. | 50 |
| Saturation | ° C. | 347.4 |
| Saturated liquid | kJ/kg | 1649.7 |
| Saturated vapour | kJ/kg | 2580.8 |
| Vaporization | kJ/kg | 931.1 |

| | | Gas | Water/Steam | Gas | Water/Steam | Gas | Water/Steam | Gas | Water/Steam |
|---|---|---|---|---|---|---|---|---|---|
| Inlet | | | | | | | | | |
| Position in FIG. 1 | | | 8 | | 17 | | 26 | | |
| mass flow rate | kg/s | | 100 | | 80 | | 48 | | |
| temperature | ° C. | | 343.4 | | 347.4 | | 347.4 | | |
| enthalpy | kJ/kg | | 1614.2 | | 1649.7 | | 1649.7 | | |
| Average | | | | | | | | | |
| temperature | ° C. | 350.4 | 345.4 | 372.5 | 347.4 | 402.3 | 372.4 | 464.0 | |

-continued

| Outlet | | | | | |
|---|---|---|---|---|---|
| Position in FIG. 1 | | 13 | 22 | 31 | |
| Steam quality | | 0.2 | 0.4 | 1.38 | |
| enthalpy | kJ/kg | 1835.9 | 2022.1 | 2935.5 | |
| temperature | ° C. | 347.4 | 347.4 | 397.4 | |
| Absorbed heat | kW | 22167 | 29796 | 61718 | |
| LMTD | ° C. | 14.2 | 38.1 | 60.6 | |
| UA | kW/° C. | 1561 | 781 | 1018 | |
| Steam extraction | | | | | |
| Position in diagram | | 16 | 25 | 34 | 35 |
| Mass flow rate | kg/s | 20 | 32 | 48 | 100 |
| enthalpy | kJ/kg | 2580.8 | 2580.8 | 2935.5 | 2751.0 |
| temperature | ° C. | 347.4 | 347.4 | 397.4 | 364.6 |
| Superheat | ° C. | 0.0 | 0.0 | 50.0 | 17.2 |

Besides the shown embodiment various embodiments are possible without leaving the scope of protection as defined in the appended claims. The shown embodiment has three evaporator stages arranged in a cascade. Alternatively, it is possible to arrange at least five or at least ten evaporator stages. Process parameters may define the necessary amount of cascading evaporator stages.

Thus, according to the invention, a steam generator is provided which may provide a stable and more reliable steam generating process.

The invention claimed is:

1. A steam generator comprising:

a substantially horizontal gas conduit (1) to guide a heating gas flow (2);

an evaporator unit positioned at least partially in the horizontal gas conduit (1) for transferring heat from the gas flow to a flow medium which flows through the evaporator unit, in which the evaporator unit comprises at least a first and a second evaporator stage (3, 4) which are arranged in a cascade, in which the first evaporator stage (3) comprises:

a first heat transfer section (12) having upright positioned heat transfer tubes which are in fluid communication with a first inlet conduit (8) to supply the flow medium to the heat transfer tubes and a first outlet conduit (13) to discharge the flow medium from the heat transfer tubes, wherein the first heat transfer section (12) is bottom fed, which means that the inlet conduit is arranged at a lower region of the heat transfer section, such that during use the flow medium is supplied from beneath via the first inlet conduit (8) to the heat transfer section (12) at a lower region and discharged via the first outlet conduit (13) at an upper region, wherein the first evaporator stage is a single pass evaporator stage in a cascade arrangement, such that a flow medium passes the substantially horizontally flowing heating gas only in upward direction from a bottom inlet to a top outlet of the evaporator stage; and a first separator (14) to separate liquid and vapor out of the flow medium coming from the first outlet conduit (13) wherein the liquid is discharged via a first liquid outlet and wherein the vapor is discharged via a second vapor outlet of the first separator (14), wherein the second evaporator stage (4) comprises a second heat transfer section (21) having upright positioned heat transfer tubes which are in fluid communication with a second inlet conduit (17) to supply the flow medium to the heat transfer tubes and a second outlet conduit (22) to discharge the flow medium from the heat transfer tubes, wherein the second heat transfer section (21) is bottom fed, which means that the inlet conduit is arranged at a lower region of the heat transfer section, such that during use the flow medium is supplied from beneath via the second inlet conduit to the heat transfer section (21) at a lower region and discharged via the second outlet conduit at an upper region, wherein the liquid outlet of the first separator (14) is connected to the second inlet conduit (17) via a first downcomer conduit (15), wherein the second evaporator stage is a single pass evaporator stage in a cascade arrangement, such that a flow medium passes the substantially horizontally flowing heating gas only in upward direction from a bottom inlet to a top outlet of the evaporator stage, wherein the second evaporator stage (4) further comprises a second separator (23) which is in fluid communication connected to the second outlet conduit (22) to separate liquid and vapor out of the flow medium coming from the second outlet conduit (22) wherein the liquid is discharged via a second liquid outlet and wherein the vapor is discharged via a second vapor outlet of the second separator (23).

2. The steam generator according to claim 1, wherein the heat transfer tubes of a heat transfer section (12, 21) are in fluid communication with each other without any choke or restrictor means like valves to throttle a through flow of a heat transfer tube with respect to another heat transfer tube of the heat transfer section.

3. The steam generator according to claim 1, wherein at least one evaporator stage (3, 4) is a once through evaporator stage.

4. The steam generator according to claim 1, wherein a by-pass conduit (39) is provided to by-pass a first evaporator stage (3) and supply flow medium to a more upstream the gas flow arranged evaporator stage (4, 5).

5. The steam generator according to claim 1, wherein the evaporator unit comprises a third evaporator stage (5) which is in fluid communication connected to the second separator (23) by a second downcomer conduit (24).

6. The steam generator according to claim 1, wherein at least the first and second evaporator stages (3, 4) are arranged in a cascade in counter-current flow with respect to the heating gas (2).

7. The steam generator according to claim 1, wherein the evaporator unit has a heat transfer section comprising a matrix of heat transfer tubes (22) having at most five arrays of transversal the gas flow arranged heat transfer tubes.

8. The steam generator according to claim 1, wherein heat transfer tubes of a heat transfer section (12, 21, 30) in successive arrays downstream the gas conduit have a substantially equal diameter in cross section.

9. The steam generator according to claim 1, wherein an auxiliary heat transfer section (6) is arranged upstream the gas flow and in series with an evaporator stage (5).

10. The steam generator according to claim 1, wherein a common vapor conduit (35) is provided for discharging vapor from the evaporator stages (3, 4, 5) to a superheater (6).

11. A method of generating steam comprising the steps of:

providing a steam generator according to claim 1;

supplying a flow medium to an evaporator unit having multiple evaporator stages;

forcing the flow medium through a first heat transfer section (12) of a first evaporator stage (3) of the evaporator unit, wherein the flow medium is supplied from beneath via the inlet conduit to the heat transfer section (12) at a lower region and discharged via the outlet conduit at an upper region;

discharging the flow medium comprising a vapor and a liquid content from the first heat transfer section to a first separator (14) which is connected to an outlet of the first evaporator stage (3);

supplying the liquid content of the flow medium from the first separator (14) to a second evaporator stage (4) having a bottom fed second heat transfer section (21) via a first downcomer conduit (15);

forcing the flow medium through a second heat transfer section (21) of the second evaporator stage (4) of the evaporator unit, wherein the flow medium is supplied from beneath via the inlet conduit to the heat transfer section (21) at a lower region and discharged via the outlet conduit at an upper region, wherein the method further comprises the steps of:

discharging the flow medium comprising a vapor and a liquid content from the second heat transfer section of the second evaporator stage (4) to a second separator (23) which is connected to an outlet conduit (22) of the second evaporator stage (4); and discharging the vapor content of the flow medium from the first and the second separator (14, 23) to a super heater (6).

* * * * *